US008684090B2

(12) United States Patent
Haugland

(10) Patent No.: US 8,684,090 B2
(45) Date of Patent: Apr. 1, 2014

(54) SLIP CONNECTION WITH ADJUSTABLE PRE-TENSIONING

(75) Inventor: Trond Haugland, Knarrevik (NO)

(73) Assignee: Norocean AS, Knarrevik (NO)

( * ) Notice: Subject to any disclaimer, the term of this patent is extended or adjusted under 35 U.S.C. 154(b) by 40 days.

(21) Appl. No.: 13/000,171

(22) PCT Filed: Jun. 18, 2009

(86) PCT No.: PCT/NO2009/000228

§ 371 (c)(1),
(2), (4) Date: Feb. 1, 2011

(87) PCT Pub. No.: WO2009/154474

PCT Pub. Date: Dec. 23, 2009

(65) Prior Publication Data

US 2011/0155388 A1 Jun. 30, 2011

(30) Foreign Application Priority Data

Jun. 20, 2008 (NO) ..... 20082794

(51) Int. Cl.
*E21B 7/12* (2006.01)
*E21B 17/07* (2006.01)

(52) U.S. Cl.
CPC ..... *E21B 17/07* (2013.01)
USPC ..... 166/344; 166/345; 166/351; 166/355

(58) Field of Classification Search
USPC ..... 166/344, 345, 351, 355, 367; 285/145.1, 298, 302
See application file for complete search history.

(56) References Cited

U.S. PATENT DOCUMENTS

| | | | | | |
|---|---|---|---|---|---|
| 3,643,751 | A | * | 2/1972 | Crickmer | 175/7 |
| 3,889,747 | A | * | 6/1975 | Regan et al. | 166/352 |
| 3,933,108 | A | * | 1/1976 | Baugh | 114/267 |
| 3,955,621 | A | * | 5/1976 | Webb | 166/355 |
| 4,047,579 | A | * | 9/1977 | Wilckens et al. | 175/7 |
| 4,290,715 | A | * | 9/1981 | Beynet et al. | 405/169 |
| 4,351,261 | A | * | 9/1982 | Shanks | 114/264 |
| 4,367,981 | A | * | 1/1983 | Shapiro | 405/224.2 |
| 4,421,173 | A | * | 12/1983 | Beakley et al. | 166/336 |
| 4,432,420 | A | * | 2/1984 | Gregory et al. | 166/355 |
| 4,487,150 | A | * | 12/1984 | Shanks | 114/264 |

(Continued)

FOREIGN PATENT DOCUMENTS

| | | |
|---|---|---|
| NO | 169027 B | 1/1992 |
| NO | 302493 B1 | 3/1998 |

(Continued)

OTHER PUBLICATIONS

International Search Report for parent application PCT/NO2009/000228, having a mailing date of Sep. 9, 2009.

*Primary Examiner* — Matthew Buck
*Assistant Examiner* — Aaron Lembo
(74) *Attorney, Agent, or Firm* — Andrus Intellectual Property Law, LLP

(57) ABSTRACT

A telescopic riser section device for a riser which is arranged to connect a wellhead to a surface vessel, the telescopic riser section being placed between the wellhead and the riser and being provided with at least one actuator arranged to apply a downward tensile force to the riser; an actuator-pressurizing circuit being connected to the at least one actuator and being arranged on the riser section and/or on the riser.

9 Claims, 5 Drawing Sheets

(56) References Cited

U.S. PATENT DOCUMENTS

| | | | | | |
|---|---|---|---|---|---|
| 4,545,437 | A * | 10/1985 | Denison | 166/345 |
| 4,557,332 | A | 12/1985 | Denison et al. | |
| 4,615,542 | A | 10/1986 | Ideno et al. | |
| 4,626,135 | A * | 12/1986 | Roche | 405/224.2 |
| 4,702,320 | A * | 10/1987 | Gano et al. | 166/343 |
| 4,712,620 | A * | 12/1987 | Lim et al. | 166/355 |
| 4,808,035 | A * | 2/1989 | Stanton et al. | 405/224.4 |
| 4,858,694 | A * | 8/1989 | Johnson et al. | 166/355 |
| 4,934,870 | A * | 6/1990 | Petty et al. | 405/199 |
| 5,069,488 | A * | 12/1991 | Freyer et al. | 285/302 |
| 5,366,324 | A * | 11/1994 | Arlt et al. | 405/195.1 |
| 5,628,586 | A * | 5/1997 | Arlt, III | 405/195.1 |
| 5,658,095 | A * | 8/1997 | Arlt et al. | 405/195.1 |
| 6,017,168 | A * | 1/2000 | Fraser et al. | 405/224.4 |
| 6,148,922 | A * | 11/2000 | Vatne | 166/367 |
| 6,230,824 | B1 * | 5/2001 | Peterman et al. | 175/214 |
| 6,325,159 | B1 * | 12/2001 | Peterman et al. | 175/7 |
| 6,530,430 | B2 * | 3/2003 | Reynolds | 166/346 |
| 6,554,072 | B1 * | 4/2003 | Mournian et al. | 166/355 |
| 6,835,026 | B2 * | 12/2004 | Gjedebo | 405/224.4 |
| 6,968,900 | B2 * | 11/2005 | Williams et al. | 166/355 |
| 7,008,340 | B2 * | 3/2006 | Williams et al. | 474/101 |
| 7,040,408 | B2 * | 5/2006 | Sundararajan et al. | 166/368 |
| 7,219,739 | B2 * | 5/2007 | Robichaux | 166/355 |
| 7,231,981 | B2 * | 6/2007 | Moe et al. | 166/355 |
| 7,237,613 | B2 * | 7/2007 | Radi et al. | 166/359 |
| 7,287,935 | B1 * | 10/2007 | Gehring | 405/223.1 |
| 7,314,087 | B2 * | 1/2008 | Robichaux | 166/355 |
| 7,334,967 | B2 * | 2/2008 | Blakseth et al. | 405/224.2 |
| 7,686,544 | B2 * | 3/2010 | Blakseth et al. | 405/224.2 |
| 7,819,195 | B2 * | 10/2010 | Ellis | 166/355 |
| 7,866,399 | B2 * | 1/2011 | Kozicz et al. | 166/367 |
| 2003/0178200 | A1 * | 9/2003 | Fox et al. | 166/341 |
| 2004/0177969 | A1 * | 9/2004 | Sundararajan et al. | 166/378 |
| 2005/0055163 | A1 * | 3/2005 | Hopper | 702/6 |
| 2005/0074296 | A1 * | 4/2005 | McCarty et al. | 405/224.4 |
| 2005/0123359 | A1 * | 6/2005 | McCarty et al. | 405/224.4 |
| 2007/0095540 | A1 * | 5/2007 | Kozicz et al. | 166/358 |
| 2007/0196182 | A1 * | 8/2007 | Ellis | 405/224.4 |
| 2009/0236144 | A1 * | 9/2009 | Todd et al. | 175/5 |
| 2011/0005767 | A1 * | 1/2011 | Muff et al. | 166/345 |
| 2011/0108282 | A1 * | 5/2011 | Kozicz et al. | 166/367 |

FOREIGN PATENT DOCUMENTS

| | | | |
|---|---|---|---|
| NO | 308379 | B1 | 9/2000 |
| WO | 97/43516 | A1 | 11/1997 |
| WO | 01/77483 | A1 | 10/2001 |

* cited by examiner

SLIP CONNECTION WITH ADJUSTABLE PRE-TENSIONING

CROSS-REFERENCE TO RELATED APPLICATIONS

This application is the U.S. national stage application of International Application No. PCT/NO2009/000228, filed Jun. 18, 2009, which International application was published on Dec. 23, 2009, as International Publication No. WO 2009/154474 A1 in the English language, which application is incorporated herein by reference. The International application claims priority of Norwegian Patent Application No. 20082794, filed Jun. 20, 2008, which application is incorporated herein by reference.

BACKGROUND

The invention relates to a telescopic riser section device, more particularly said riser section being provided with at least one actuator arranged to apply a downward tensile force to the riser, an actuator-pressurizing circuit being connected to the at least one actuator and being arranged on the riser section and/or on the riser.

Risers of this kind normally form a connection between a subsea well and a surface vessel, a number of conduits and pipes being extended between the well and the surface vessel. At its lower end, the riser is fitted to subsea equipment, such as blowout preventer valves, wellheads or similar, and at its upper end, it is connected to the surface vessel, for example a drillship or a platform.

The riser must continuously be kept under tension, and this is normally achieved by so-called heave compensators arranged on the surface vessel, steel ropes attached to the riser being kept taut by means of winches or hydraulic/pneumatic cylinders provided with pressure sources and accumulators. It is also known to use hydraulic/pneumatic cylinders directly, that is without any steel ropes. The heave compensating system must be dimensioned to take up the weight of the riser and any fluid inside it. Moreover, the system must be controllable to provide the so-called heave compensation, that is to say the vertical wave motion is compensated, so that the heave movements of the surface vessel are transferred to the riser to the least possible extent.

To be able to maintain a continuous riser connection between the well and vessel also during the vertical heave movements of the vessel, it is known to provide the upper end portion of the riser with a telescopic pipe section. It is also known to arrange the telescopic pipe section at another portion of the riser.

On interruption of a borehole operation, it may be relevant to pull the surface vessel away from the well, by shutting off the well and disconnecting the riser from the wellhead.

From U.S. Pat. No. 4,557,332 is known a riser with ballast units which provide some buoyancy in the riser. At the attachment of the riser to the surface vessel are arranged means which are arranged to pull the entire riser upwards, so that the lower end portion of the riser achieves a safe distance to the wellhead.

During operations at great depths and with correspondingly long risers, the heave-compensating suspension device will require a considerable lifting capacity because of the large mass of the riser, which complicates the surface vessel and increases its cost. For that reason, it may be appropriate to arrange the telescopic pipe section at the lower end portion of the riser, the riser being suspended directly from the surface vessel without any form of heave compensation.

From NO 308379 is known a riser which extends between a piece of subsea equipment and a surface vessel, wherein the riser is provided with a telescopic section at the lower end of the riser, heave compensation being effected by the telescopic movability of the riser, whereas, by such suspension, the mass of the riser keeps the riser under tension. There are also described means for pre-tensioning the telescopic section by a flange, arranged on the inner pipe and enclosed by the outer telescoping pipe, being arranged to be pressure-loaded for pre-tensioning purposes by means of the water pressure and/or by the use of spring force.

SUMMARY

The invention has for its object to remedy or to reduce at least one of the drawbacks of the prior art.

The object is achieved through features which are specified in the description below and in the claims that follow.

The invention provides a telescopic riser section device arranged between a wellhead and a riser and provided with at least one actuator arranged to apply a downward tensile force to the riser. An actuator-pressurizing circuit is connected to the at least one actuator and is arranged on the riser section and/or on the riser. A connection is thereby provided between the riser and wellhead, formed by the telescopic riser section, the riser section providing a prescribed tensioning of the riser adjusted for the prevailing conditions, for example varying load on the riser from drilling mud carried through the riser, and also a possibility of contracting the telescopic riser section if the riser has to be disconnected from the wellhead, so that the riser achieves a safe clearance from the wellhead without the riser itself having to be lifted by a surface vessel to which the riser is connected.

More specifically, the invention relates to a telescopic riser section device for a riser which is arranged to connect a wellhead to a surface vessel, characterized by the telescopic riser section being placed between the wellhead and the riser and being provided with at least one actuator arranged to apply a downward tensile force to the riser; an actuator-pressurizing circuit being connected to the at least one actuator and being arranged on the riser section and/or on the riser.

The at least one actuator may form an annular space between an outer telescoping pipe and an inner telescoping pipe, the annular space being provided with a pressure fluid in liquid form and being connected in a fluid-communicating manner to the actuator-pressurizing circuit.

Alternatively, the at least one actuator may be formed as several hydraulic cylinders arranged parallel to and outside the telescopic riser section.

The actuator-pressurizing circuit may include a pressure-fluid accumulator, in which a fluid-tight element forms a movable interface between a first pressure-fluid chamber and a second pressure-fluid chamber, the second pressure-fluid chamber being in fluid communication with the at least one actuator, and the first pressure-fluid chamber being in fluid communication with at least one pressure-fluid reservoir provided with a pressure fluid in gaseous form.

The pressure-fluid accumulator may be a cylinder provided with a floating piston.

The actuator-pressurizing circuit may include means for adjusting the fluid pressure within the first pressure-fluid chamber.

The pressure-fluid reservoir may be provided with a pressure intensifier.

The pressure intensifier may be a second gas reservoir.

The pressure intensifier may be a pump.

The actuator-pressurizing circuit may be arranged for remote-control from the surface vessel.

The telescopic riser section may be provided with means for limiting the axially contracting movement of an outer telescoping pipe on an inner telescoping pipe.

The inner telescoping pipe may be provided with a flange projecting radially, which is arranged to abut against an end portion of the outer telescoping pipe.

The telescopic riser section may be provided with means arranged for the axial, mechanical fixation of the inner telescoping pipe relative to the outer telescoping pipe independently of the at least one actuator when the riser section is contracted.

BRIEF DESCRIPTION OF THE DRAWINGS

In what follows is described an example of a preferred embodiment which is visualized in the accompanying drawings, in which.

DETAILED DESCRIPTION OF THE DRAWINGS

Figure 1:
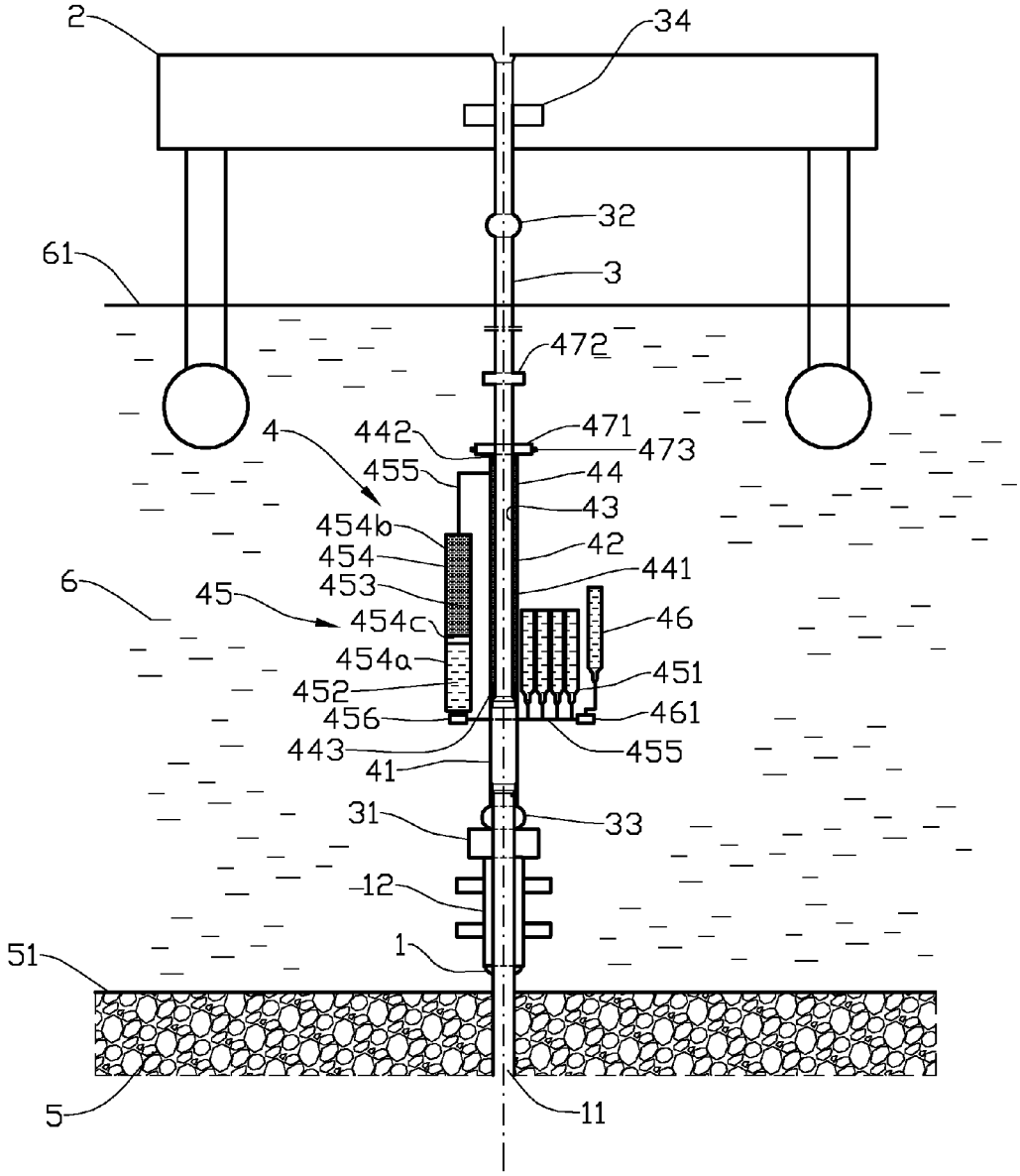
FIG. 1 shows a principle drawing of a surface vessel connected to a wellhead via a riser provided with a telescopic riser section according to the invention.

In the drawings the reference numeral 1 indicates a wellhead for a subsea well 11 arranged in an underground structure 5, the wellhead 1 being on a seabed 51 under a water mass 6. A surface vessel 2 is floating on a sea surface 61. The wellhead 1 is provided, in a manner known per se, with a blowout preventer 12.

Between the blowout preventer 12 of the wellhead 1 and the surface vessel 2 extends a riser 3 arranged to accommodate, in a manner known per se, various conduits and pipe strings (not shown), for example a drill string or production tubing, or the pipe bore of the riser 3 functions as a conduit for a fluid. The riser 3 is suspended from the surface vessel 2 via a fixed riser suspension 34, known per se. The riser 3 is secured to the blowout preventer 12 by means of a riser connector 31, a so-called LMRP of the prior art known per se, including means (not shown) for remote control. To take up angular deviations between the riser 3 and its connected structures 2, 12, caused by horizontal movements of the surface vessel 2 and/or riser 3 owing to drift etc., the riser 3 is provided with upper and lower riser joints 32, 33 of the prior art known per se.

The lower end portion of the riser 3 is formed as a telescopic riser section 4. An outer telescoping pipe 41 is connected to the lower riser joint 33 and extends upwards, surrounding the inner telescoping pipe 42 which is arranged to be moved axially within the outer telescoping pipe 41. Between the inner and outer telescoping pipes 41, 42 is formed an annular space 441 defined axially by first and second gasket sets 442, 443, the first gasket set 442 being secured internally in an upper end portion of the outer telescoping pipe 41, bearing against the outer jacket surface of the inner telescoping pipe 42, and the second gasket set 443 being secured externally in a lower end portion of the inner telescoping pipe 42, bearing on the inner jacket surface of the outer telescoping pipe 41, the gasket sets 442, 443 providing a pressure-sealing connection between the outer and inner telescoping pipes 41, 42. The annular space 441, the gasket sets 442, 443 and the adjacent telescoping pipes 41, 42 form an annular actuator 44.

Figure 5:
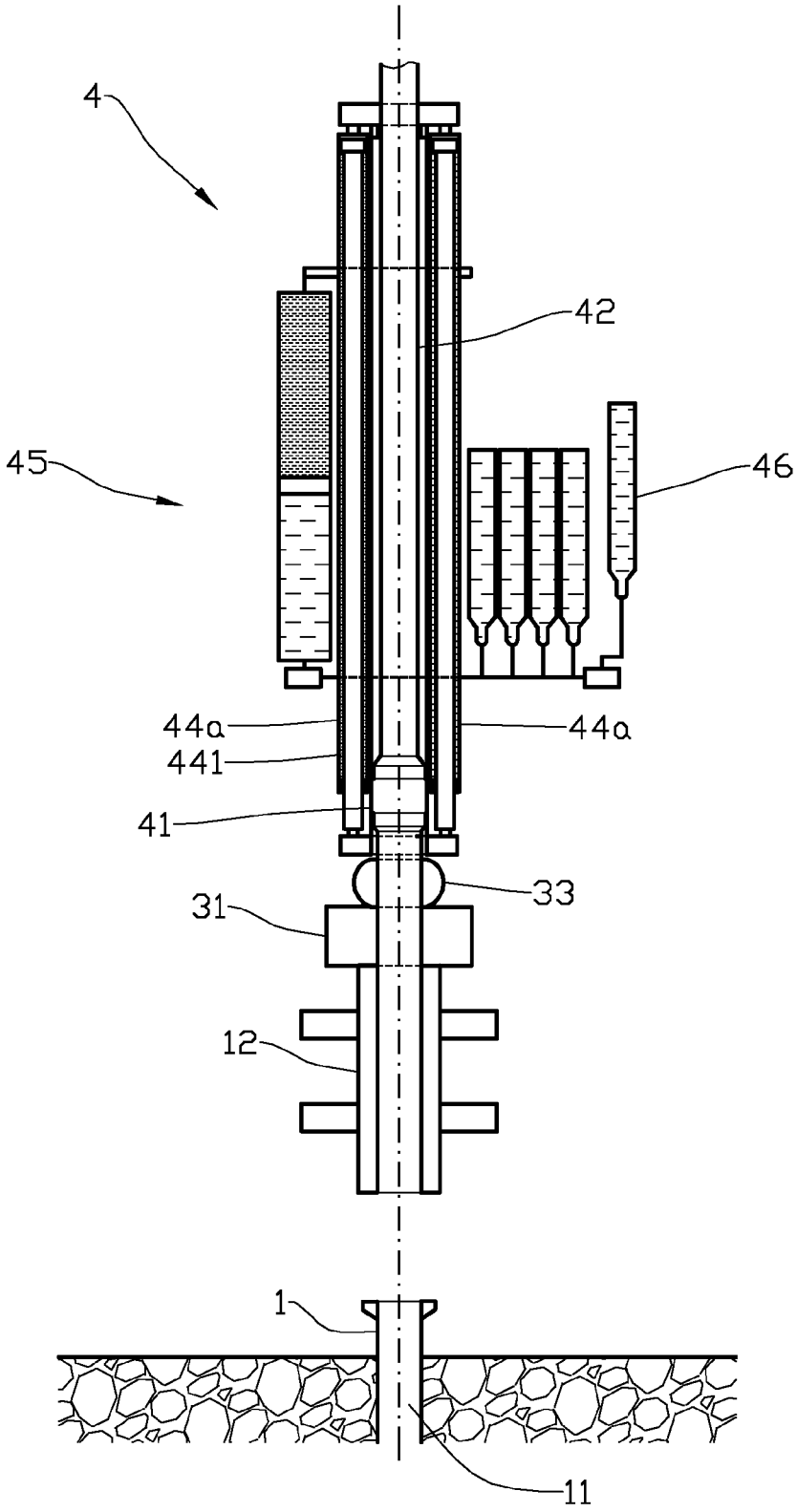
FIG. 5 shows the same situation as in FIG. 3 with an alternative actuator embodiment.

In an alternative embodiment there are formed several actuators outside the telescope unit 4, as several hydraulic cylinders 44*a* (see FIG. 5) are arranged in parallel and between an upper portion of the inner telescoping pipe 41 and a lower portion of the outer telescoping pipe 42.

The telescopic riser section 4 forms a continuous pipe bore 43 concentric with the pipe bore of the riser 3.

An actuator-pressurizing circuit 45 is connected to the actuator(s) 44, 44*a*. A pressure-fluid reservoir 451 contains a first pressure fluid 452 which is connected, in a fluid communicating manner, via a remote-controlled first valve 456 and pressure-fluid lines 455 to a first chamber 454*a* in an accumulator 454. The first valve 456 is arranged to maintain a prescribed fluid pressure in the first chamber 454*a* by supplying the first pressure fluid 452 from the pressure-fluid reservoir 451 or by bleeding of the first pressure fluid 452 into the surrounding water mass 6. A second chamber 454*b* which is filled with a second pressure fluid 453 is separated in a fluid-tight manner from the first chamber 454*a* by means of a movable piston 454*c*. The second chamber 454*b* is connected in a fluid-communicating manner to the annular space 441 of the actuator 44, 44*a* via a pressure line 455. The second pressure fluid 453 fills the annular space 441 between the first and second gasket sets 442, 443.

The first pressure fluid 452 is a gas, for example nitrogen.

The second pressure fluid 453 is hydraulic oil or some other liquid suitable for applying hydraulic pressure to the actuator 44.

To the actuator-pressurizing circuit 45 there is connected, via a second remote-controlled valve 461, a pressure intensifier 46. The pressure intensifier 46 contains a first pressure fluid 452 at a higher pressure than that exhibited by the pressure-fluid reservoir 451. The second valve 461 is arranged to apply a prescribed, elevated fluid pressure to the actuator-pressurizing circuit 45 by supplying the first pressure fluid 452 from the pressure intensifier 46.

Figure 4:
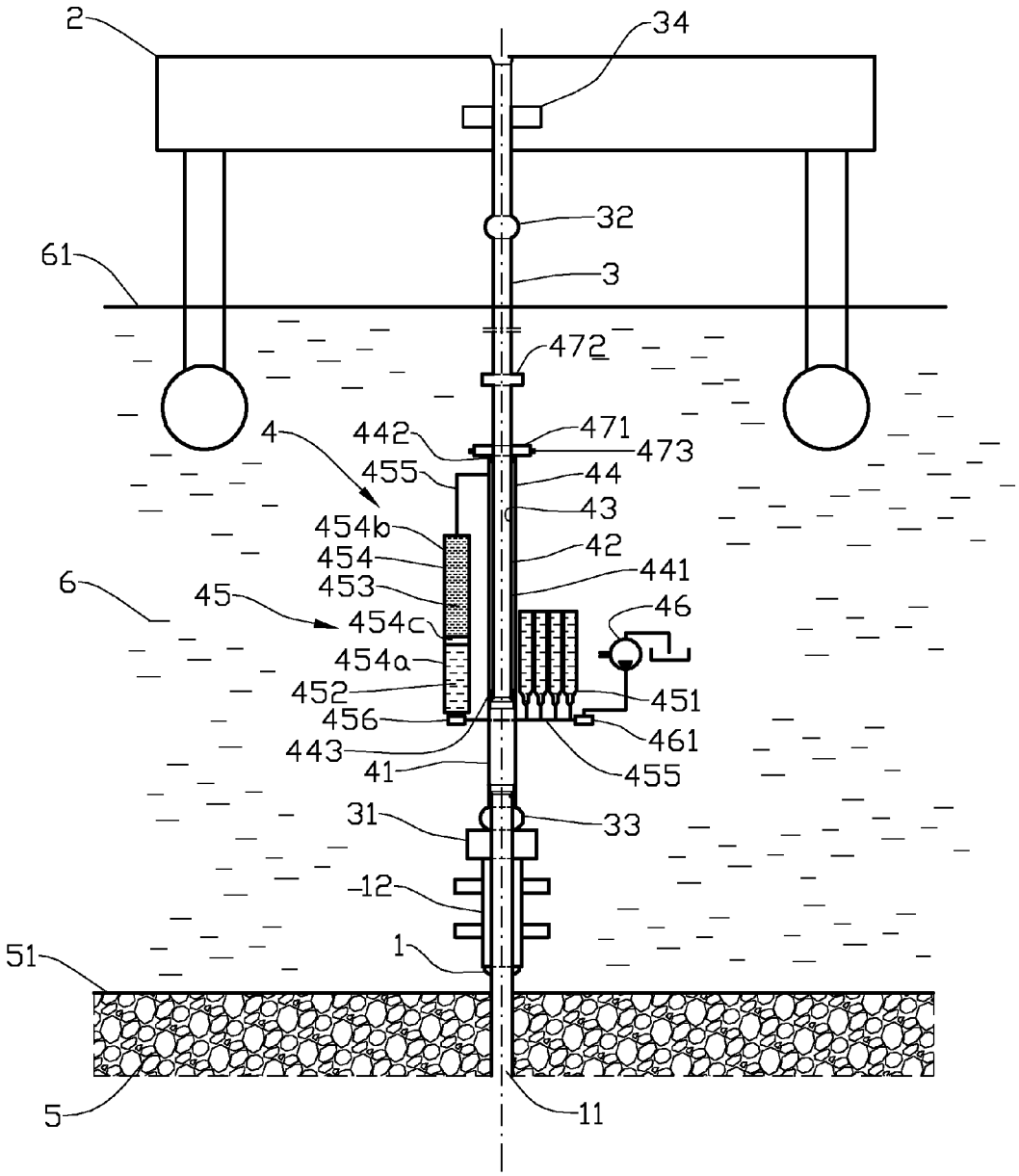
FIG. 4 shows, on the same scale, an alternative embodiment.

In an alternative embodiment (shown in FIG. 4), which is the same as FIG. 1, except the pressure intensifier 46 is arranged remotely from the pressure-fluid reservoir 451, for example in the form of a pump arranged on the surface vessel 2 and connected to the actuator-pressurizing circuit 45 via a second pressure-fluid line arranged inside or on the outside of the riser 3.

At its upper end portion, the telescopic riser section 4 is provided with an end stop in the form of a flange 471 arranged on the outer telescoping pipe 41, and a flange abutment 472 arranged on the inner telescoping pipe 42. As the telescopic riser section 4 is contracted, the contraction will be restricted by the abutment of the flange 471 against the flange abutment 472.

Figure 3:
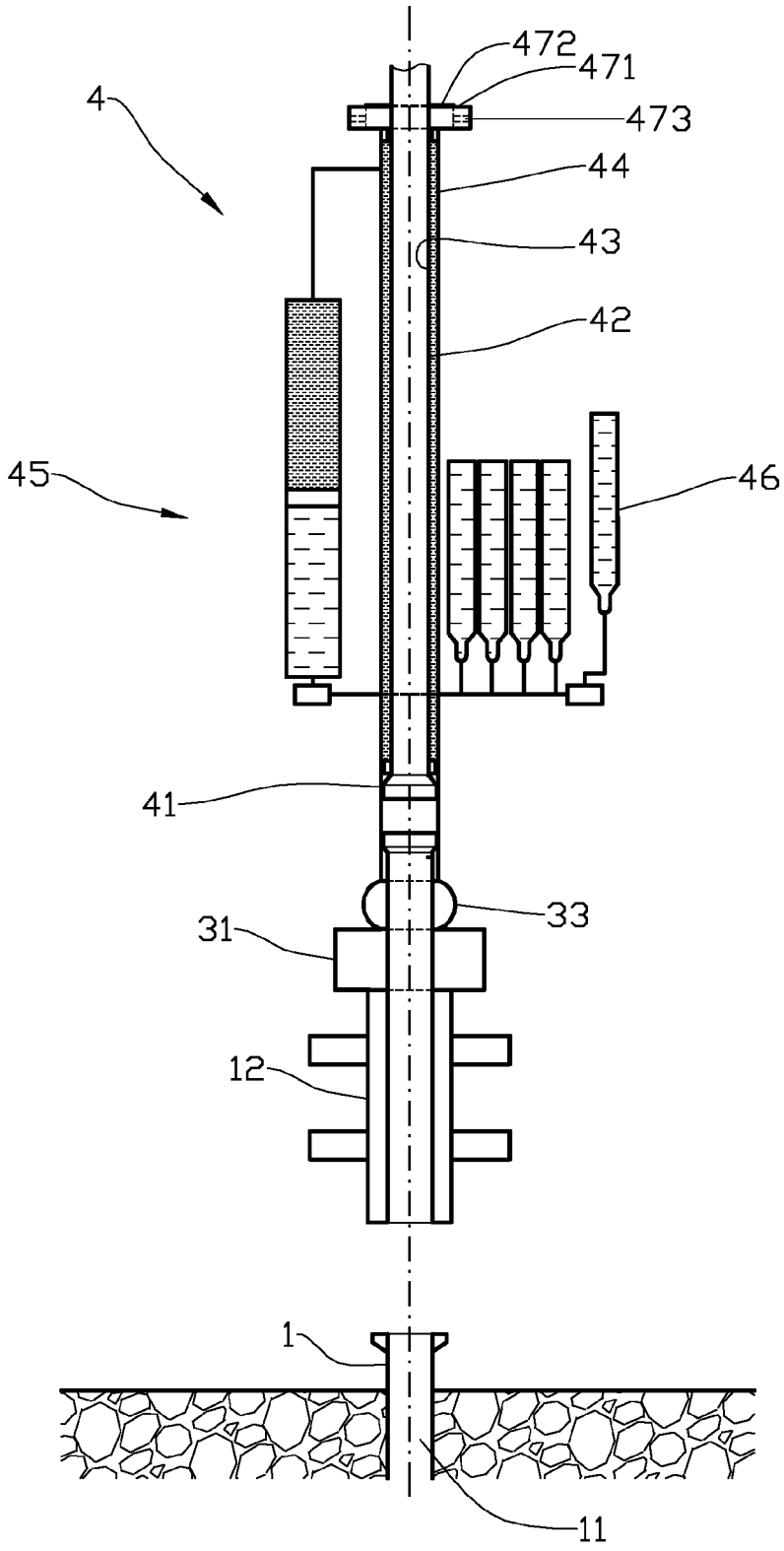
FIG. 3 shows, on the same scale, a situation in which the telescopic riser section is locked in its contracted position for landing a blowout preventer by means of the riser.

The flange abutment 472 is provided with remote-controlled locking bolts 473 arranged to engage the flange 471 as the telescopic riser section 4 has been contracted completely. See FIG. 3.

The first valve 456 of the actuator-pressurizing circuit 45 is arranged to apply a prescribed pressure to the actuator 44, restricted to the fluid pressure of the pressure-fluid reservoir 451. The actuator 44 thereby apply a downward tensile force to the riser 3, providing for the riser 3 to be kept tautened independently of the vertical movement (heave motion) of the surface vessel 2 caused by waves on the sea surface 61 or some other influence.

Whenever there is a need for actuator-tensioning force beyond that generatable by the pressure-fluid reservoir 451, the connection between the actuator-pressurizing circuit 45 and the pressure intensifier 46 is opened by operating the second valve 461. This is arranged to increase the fluid pressure in the actuator 44 up to a prescribed limit value determined by the maximum fluid pressure of the pressure intensifier 46, the maximum pressure design value of the actuator-pressurizing circuit 45 or some other control parameter.

Figure 2:
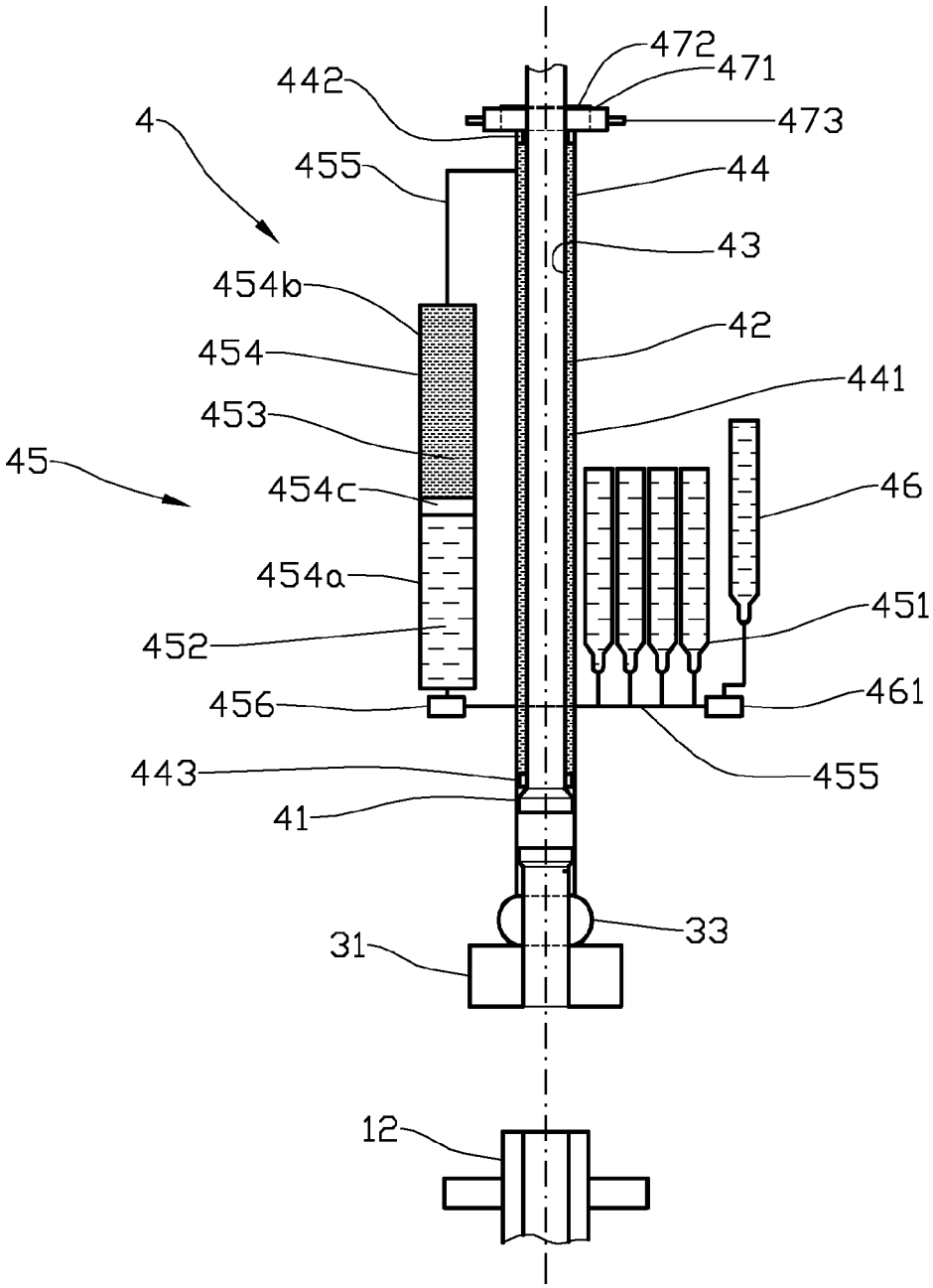
FIG. 2 shows, on a larger scale, a section of FIG. 1 in which the riser has been detached from the wellhead and the telescopic riser section has been contracted.

When, for some reason, the riser 3 has to be disconnected from the wellhead 1, for example because the surface vessel 2 must be moved away from the well 11 because of bad weather, the telescopic riser section 4 is disconnected from the blowout preventer 12 by means of a riser connector 31. Because the actuator 44 is pressurized, the detaching of the riser 3 from the blowout preventer 12 will cause the outer telescoping pipe 41 to be moved upwards until abutment of the flange 471 against the flange abutment 472, which provides a clearance between the structures 12 of the wellhead 1 projecting upwards and the riser 3, so that the surface vessel 2 with the depending riser 3 can be moved away from the wellhead 11. See FIG. 2.

The characteristics of the remote-controlled locking bolts 473 of the flange abutment 472, which are arranged to engage the flange 471 as the telescopic riser section 4 has been contracted completely, provide a possibility of lowering a blowout preventer 12, for example, onto the wellhead 1 by the blowout preventer 12 hanging on the contracted riser section 4 while the riser 3 is lowered from the surface vessel 2 in accordance with the prior art, the riser constantly being extended and there being used heave compensators in the last phase for hanging off the riser 3 in the surface vessel 2. After the blowout preventer 12 has been landed and secured to the wellhead 1, the locking bolts 473 are deactivated, the riser 3 is lifted somewhat, so that the riser section 4 is partly pulled out to work, lengthwise, around a mid position, the suspension 34 of the riser 3 is secured to the surface vessel and the pressure in the accumulator 44 is adjusted so that the riser is tensioned.

Pulling the blowout preventer 12 by means of the riser 3 may be carried out by reversing the operation described above for landing.

The invention claimed is:

1. A telescopic riser section device for a riser having a bottom end and a top end, said bottom end being arranged to connect to a wellhead and said top end being arranged to connect to a surface vessel, the device comprising:

a telescopic pipe section disposed between the wellhead and the bottom end of the riser;

at least one actuator arranged to cause a telescoping movement between the telescopic pipe section and the riser so as to apply a downward tensile force to the riser when the riser is connected to the well head and so as to lift the telescopic pipe section away from the well head when the riser is disconnected from the well head;

an actuator-pressurizing circuit having a pressure fluid accumulator, the actuator-pressurizing circuit being connected to the at least one actuator and being arranged on the telescoping pipe section;

wherein the actuator is selected from a group consisting of:

a) a plurality of hydraulic cylinders arranged parallel with and outside of the telescopic pipe section, and b) an annular space between the telescoping pipe section and the bottom end of the riser, the actuator being actuated by a pressure fluid in liquid form supplied by the actuator-pressurizing circuit which is connected in a fluid-communicating manner to the annular space;

wherein an upper end of the telescoping pipe section has a flange that abuts against a flame abutment on the riser, and comprising remote controlled locks on the flange abutment, wherein the remote controlled locks hold the telescoping pipe section in a raised position above the well head when the telescoping pipe section is lifted away from the well head.

2. The device in accordance with claim 1, wherein the pressure-fluid accumulator is a cylinder provided with a floating piston.

3. The device in accordance with claim 1, wherein the actuator-pressurizing circuit comprises means for adjusting the fluid pressure within a first pressure-fluid chamber.

4. The device in accordance with claim 1, wherein the actuator-pressurizing circuit further comprises a pressure-fluid reservoir having a pressure intensifier connected thereto.

5. The device in accordance with claim 4, wherein the pressure intensifier is a second gas reservoir.

6. The device in accordance with claim 4, wherein the pressure intensifier is a pump.

7. The device in accordance with claim 1, wherein the actuator-pressurizing circuit is arranged for remote control from the surface vessel.

8. The device in accordance with claim 1, the actuator comprises the plurality of hydraulic cylinders arranged parallel with and outside the telescopic pipe section.

9. The device in accordance with claim 1, wherein the actuator comprises the annular space between the telescoping pipe section and the bottom end of the riser, the actuator being actuated by a pressure fluid in liquid form supplied by the actuator-pressurizing circuit being connected in a fluid-communicating manner to the annular space.

* * * * *